US011841202B1

(12) United States Patent
Kangas

(10) Patent No.: US 11,841,202 B1
(45) Date of Patent: Dec. 12, 2023

(54) FIREARM STABILIZING SYSTEM

(71) Applicant: Jaime John Kangas, Eveleth, MN (US)

(72) Inventor: Jaime John Kangas, Eveleth, MN (US)

( * ) Notice: Subject to any disclaimer, the term of this patent is extended or adjusted under 35 U.S.C. 154(b) by 0 days.

(21) Appl. No.: 17/855,136

(22) Filed: Jun. 30, 2022

(51) Int. Cl.
*F41A 23/04* (2006.01)
*F41A 23/12* (2006.01)

(52) U.S. Cl.
CPC ..... *F41A 23/04* (2013.01); *F41A 23/12* (2013.01)

(58) Field of Classification Search
CPC ..... F41A 23/00; F41A 23/005; F41A 23/02; F41A 23/04; F41A 23/06; F41A 23/08; F41A 23/10; F41A 23/12; F41A 23/14; F41A 23/16; F41A 23/18; F41A 23/52
USPC ..... 42/94; 89/37.01, 37.12, 37.03, 37.04
See application file for complete search history.

(56) References Cited

U.S. PATENT DOCUMENTS

| | | | | |
|---|---|---|---|---|
| 6,042,080 | A | 3/2000 | Shepherd | |
| 7,377,474 | B2 | 5/2008 | Curtis | |
| 7,434,773 | B1 * | 10/2008 | Minjares | F41B 5/1426 124/86 |
| 8,695,935 | B1 | 4/2014 | Brust et al. | |
| 9,631,737 | B2 | 4/2017 | Brust et al. | |
| 10,733,917 | B2 | 8/2020 | Davison | |
| 10,808,880 | B1 * | 10/2020 | Gearing | F16M 11/14 |
| 11,168,830 | B2 * | 11/2021 | Bryant | F16M 11/26 |
| 2004/0118985 | A1 * | 6/2004 | Omps | F16M 11/041 248/187.1 |
| 2007/0114346 | A1 * | 5/2007 | Omps | F16M 11/14 248/181.1 |
| 2017/0115090 | A1 * | 4/2017 | Bofill | F41B 5/123 |
| 2018/0112947 | A1 * | 4/2018 | Reik | F41A 23/18 |

FOREIGN PATENT DOCUMENTS

| | | |
|---|---|---|
| WO | WO2018087657 | 11/2016 |
| WO | WO2019237147 | 6/2018 |

* cited by examiner

*Primary Examiner* — John Cooper

(57) ABSTRACT

A firearm stabilizing system includes a first mating member attached to a bottom surface of the firearm. A second mating member is mounted on an upper edge of a wall. The first and second mating members are magnetically attached to each other to stabilize the firearm when the firearm is being discharged.

12 Claims, 6 Drawing Sheets

FIREARM STABILIZING SYSTEM

CROSS-REFERENCE TO RELATED APPLICATIONS

Not Applicable.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention.

The disclosure relates to firearm firing mount and more particularly pertains to a new firearm firing mount for allowing a hunter to smoothly rotate a rifle relative to a fixed position to facilitate aiming while being positioned in a hunting stand or other similar structure.

(2) Description of Related Art Including Information Disclosed Under 37 CFR 1.97 and 1.98.

The prior art relates to firearm firing mounts that typically include a saddle type structure for receiving the barrel of a gun but are not suited well for usage in small places such as hunting stands. Additionally, these devices are not magnetized and therefore do not readily hold a firearm in position while allowing for ease of aiming.

BRIEF SUMMARY OF THE INVENTION

An embodiment of the disclosure meets the needs presented above by generally comprising a first mating member attached to a bottom surface of the firearm. A second mating member is mounted on an upper edge of a wall. The first and second mating members are magnetically attached to each other to stabilize the firearm when the firearm is being discharged.

In another embodiment of the disclosure, the system includes a first mating member configured to be attached to a bottom surface of the firearm. A second mating member configured to be mounted on a support member. The first and second mating members being matingly attached to each other to stabilize the firearm when the firearm is being discharged. The first and second mating members being rotatable with respect to each other when the firearm is being stabilized by the first and second mating members.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
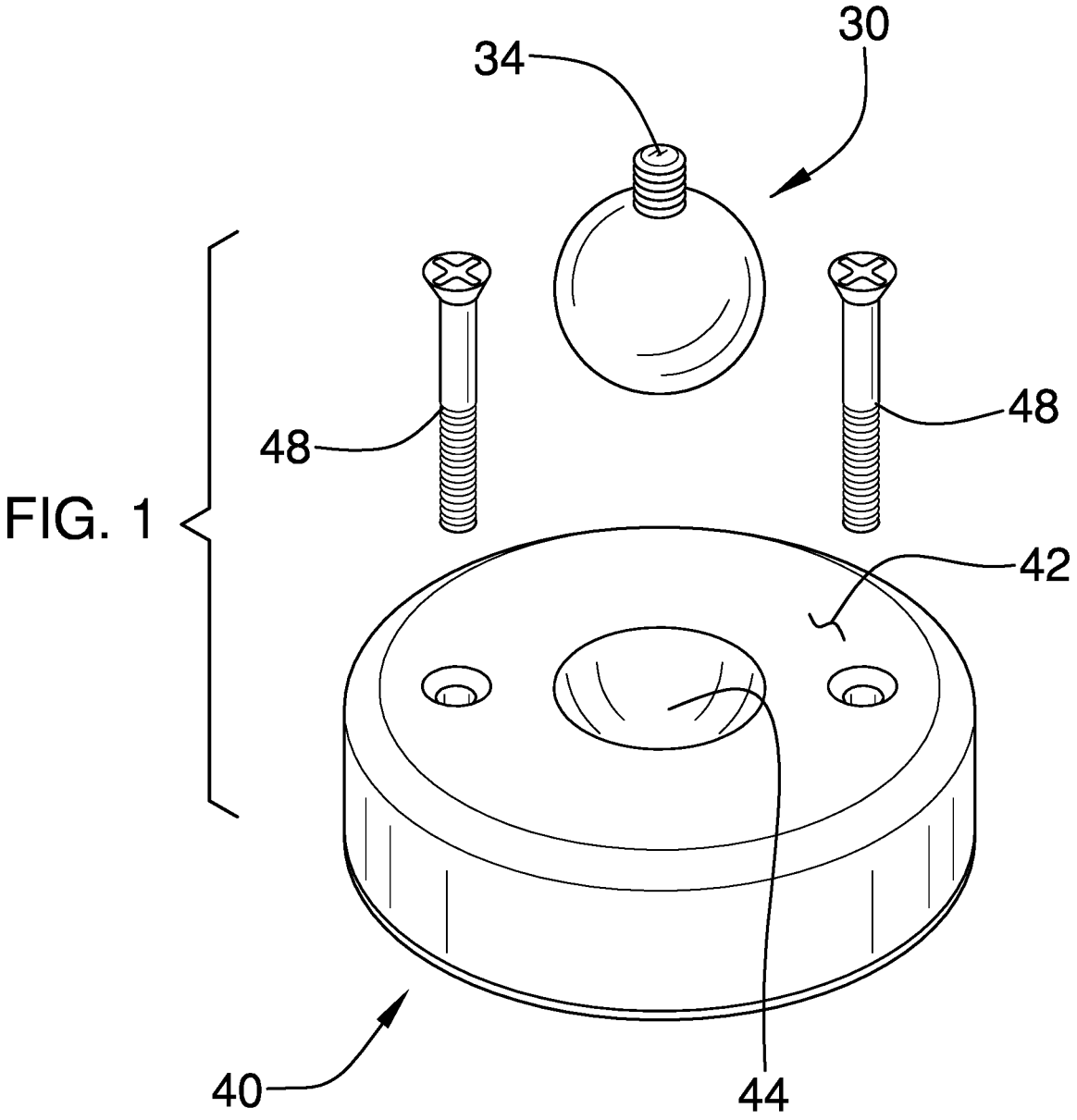
FIG. 1 is a top isometric exploded view of a firearm stabilizing system according to an embodiment of the disclosure.
Figure 2:
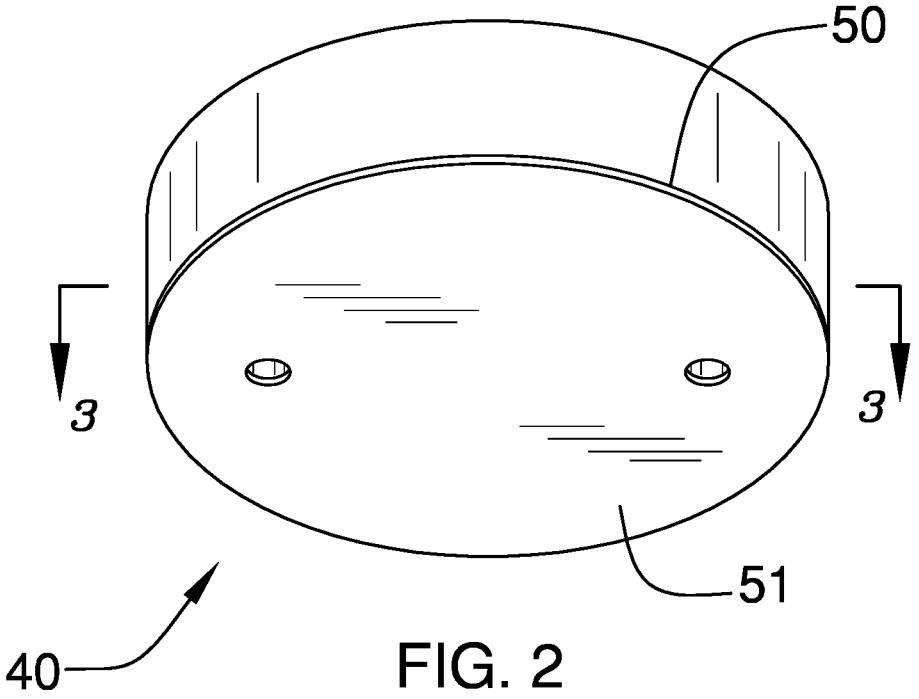
FIG. 2 is a bottom isometric view of a second mating member of an embodiment of the disclosure.
Figure 3:
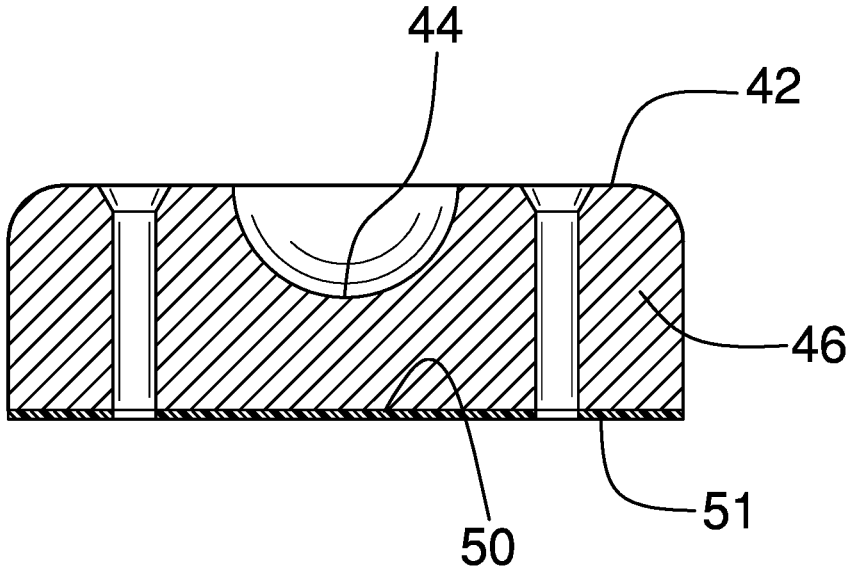
FIG. 3 is a cross-sectional view of an embodiment of the disclosure taken along line 3-3 of FIG. 2.
Figure 4:
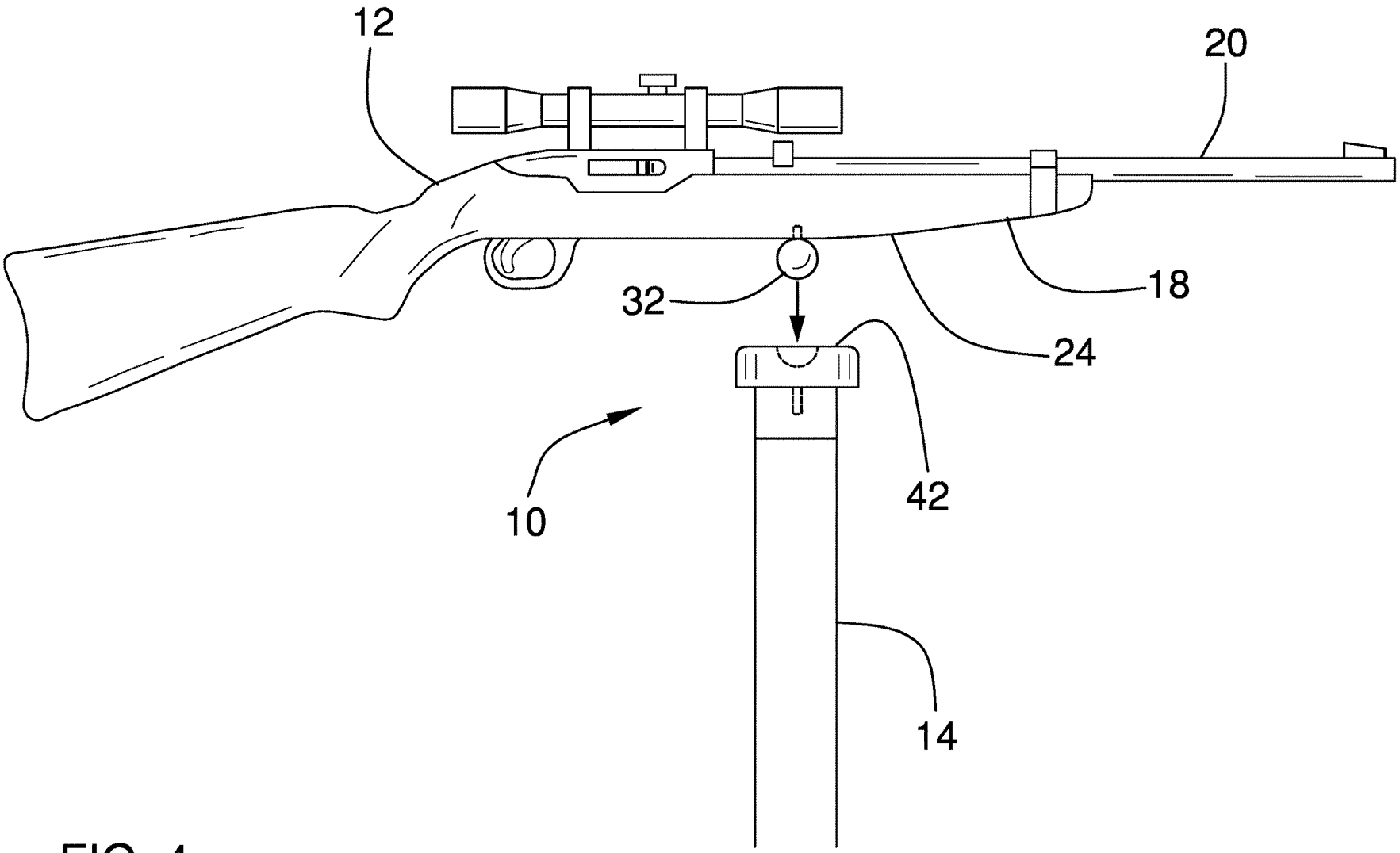
FIG. 4 is a side view of an embodiment of the disclosure.
Figure 5:
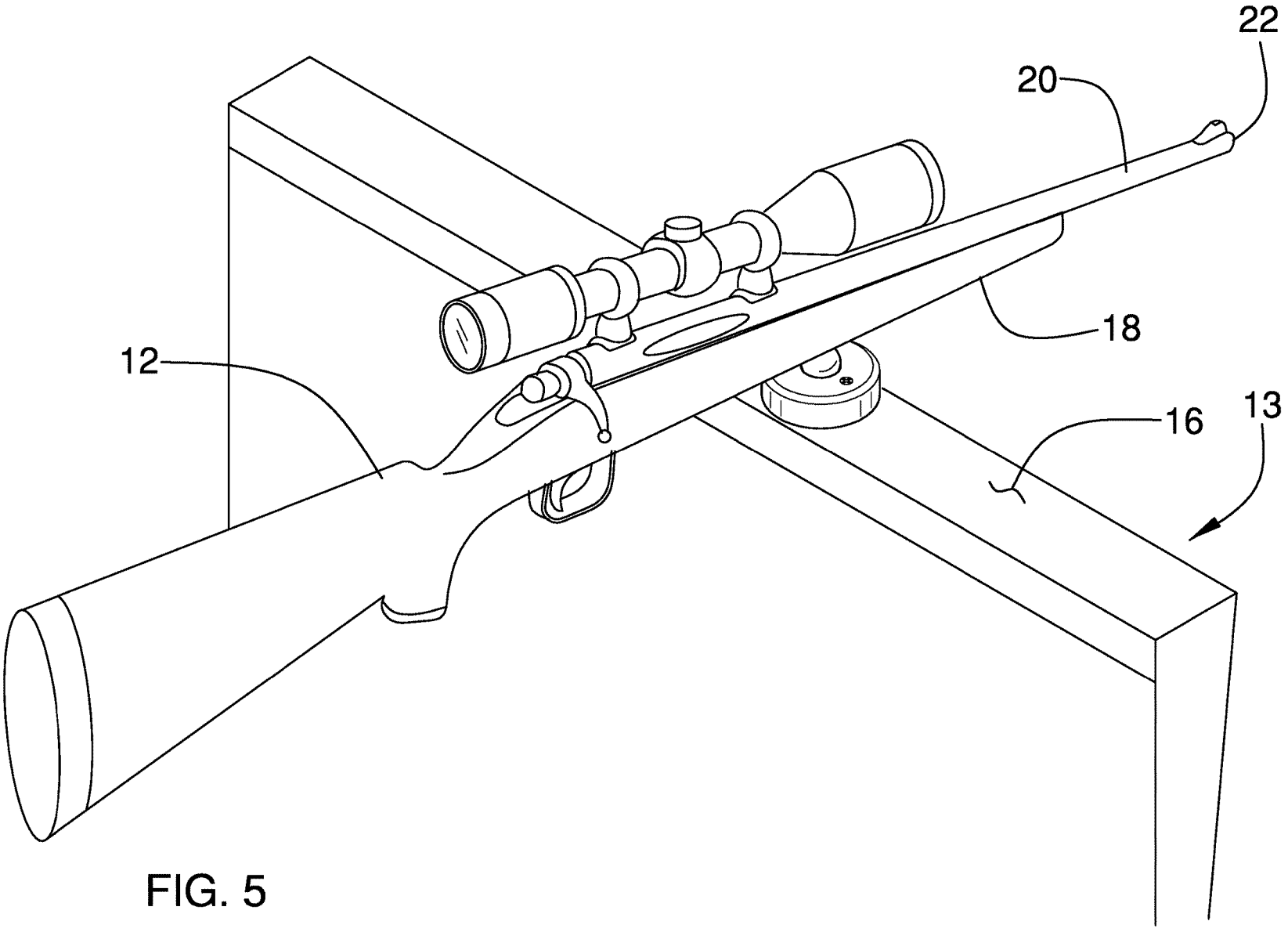
FIG. 5 is a rear isometric in-use view of an embodiment of the disclosure.
Figure 6:
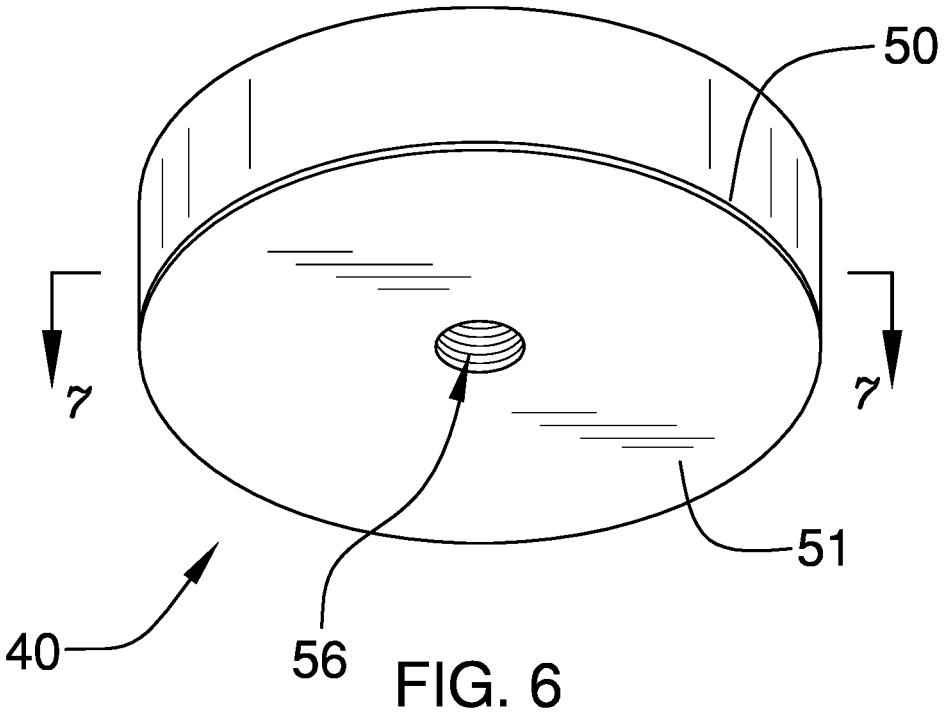
FIG. 6 is a bottom isometric view of a second embodiment of the disclosure.
Figure 7:
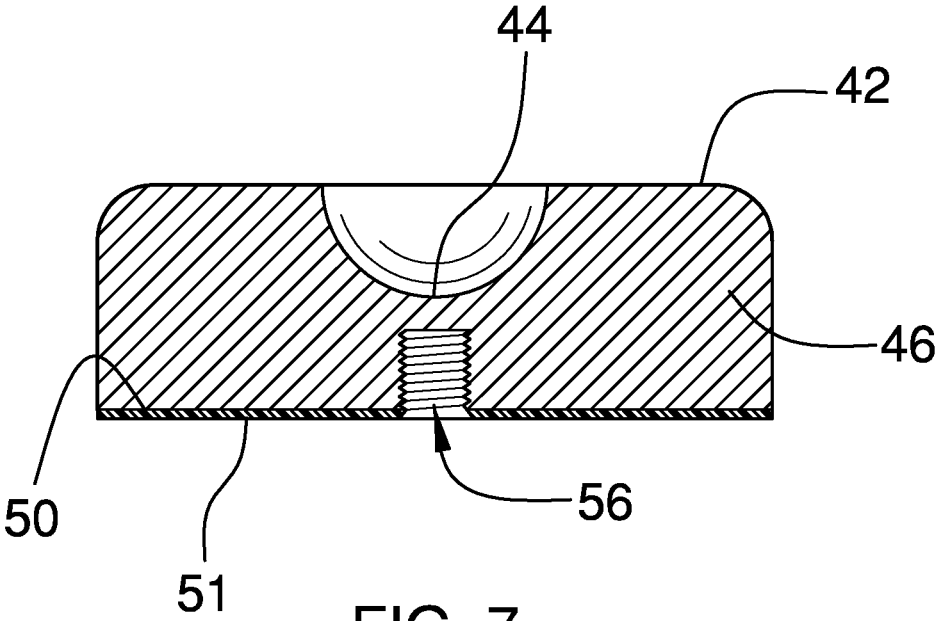
FIG. 7 is a cross-sectional view of an embodiment of the disclosure taken along line 7-7 of FIG. 6.
Figure 8:
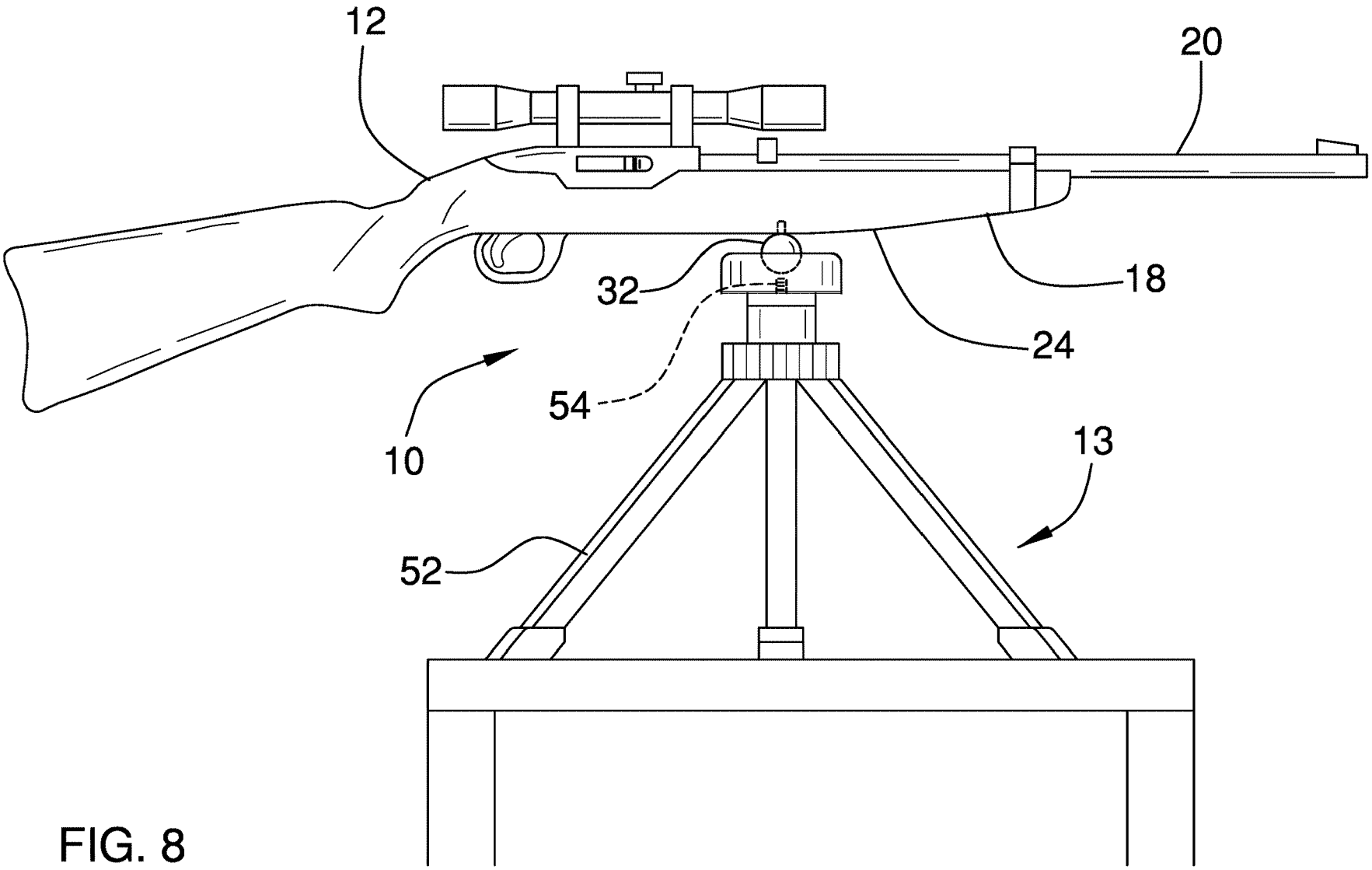
FIG. 8 is a side in-use view of an embodiment of the disclosure as shown in FIG. 6.

With reference now to the drawings, and in particular to FIGS. 1 through 8 thereof, a new firearm firing mount embodying the principles and concepts of an embodiment of the disclosure and generally designated by the reference numeral 10 will be described.

As best illustrated in FIGS. 1 through 8, the firearm stabilizing system 10 generally comprises a system and assembly to stabilize a firearm 12 for facilitating aiming of the firearm 12 when shooting/discharging the firearm 12. The system 10 prevents unwanted lateral, forward, rearward, and vertical movement of the firearm 12 while the user is aiming by stabilizing the firearm 12 on a support member 13. Often the firearm 12 will comprise a rifle which would be used while hunting from a hunting stand or other structure wherein the support member 13 may comprise a vertical wall 14 is available for engagement with the system 10. The term "wall" may comprise any structure used particularly for safety purposes to retain a person within a specified space and therefore may include fencing, guard rails, and the like.

The system 10 includes a first mating member 30 configured to be attached to a bottom surface 24 of the firearm 12 and more particularly will usually be attached to the stock 18 of a rifle between the trigger and the end 22 of the barrel 20. In one embodiment, a second mating member 40 is provided which is configured to be mounted on the upper edge 16 of the wall 14. The first 30 and second 40 mating members are magnetically attached to each other to stabilize the firearm 12 when the firearm 12 is being discharged. That is, the first 30 and second 40 mating members are only securable to each other by magnetic forces such that a user of the system 10 need not disengage any mechanical fasteners to release the first mating member 30 from the second mating member 40.

When engaged with each other, the first mating member 30 and the second mating member 40 are rotatable in all three axes with respect to each other. This allows the user to pivot and aim the barrel 20 where desired while ensuring that the firearm 12 maintains a substantially fixed point with respect to the wall 14.

In one embodiment, the first mating member 30 has a lower portion 32 that is convexly arcuate, while the second mating member 40 has an upper surface 42 including a concavely arcuate depression 44 for receiving the first mating member 30. Thus, the first mating member 30 fits into the second mating member 40 and can smoothly rotate relative to the second mating member 40. As can be seen in the Figures, the first mating member 30 may have a spherical shape and comprise a ball bearing type shape having a diameter of between .75 inches and 2.0 inches. A connector 34 is attached to the first mating member 30 and releasably attaches the first mating member 30 to the firearm 12 such that the first mating member 30 extends downwardly from the bottom surface 24. The connector 34 may comprise a threaded coupler that is threadably extended into and attached to the stock 18 of the firearm 12. The first mating member 30 may comprise a ferromagnetic material such as iron, nickel, cobalt and other common magnetically active materials.

The second mating member 40 includes a plate 46 wherein the concavely arcuate depression 44 is positioned in a central area of the upper surface 42 of the plate 46. A plurality of fasteners 48 extends through the plate 46 and into the upper edge 16 of the wall 14 to releasably retain the plate 46 on the wall 14. The plate 46 may include an embedded magnetic panel, though it should be understood that the plate 46 itself may be comprised of a ferromagnetic material such that either the first mating member 30 or the plate 46 may be magnetized. Moreover, each of the first 30 and second 40 mating members may be magnetized. The strength of the magnetic attraction between the first 30 and second 40 mating members may be altered depending on the type of firearm 12 being used as well as the preferences of the user of the system 10.

It should be noted that first mating member 30 and second mating member 40, due to their shapes, may be provided without a magnetic connection between them. The magnetic connection may be advantageous to better secure the firearm 12 to the support member 13. Also, should the second mating member 30 be magnetically active, it may magnetically attach to metallic surfaces, without fasteners 48, which may act as the support member 13. Thus, a bottom side 50 of the plate 46 may be coated with an elastomeric or plastic layer 51 to prevent damage to any articles it is magnetically coupled to. In some embodiments, the support member 13 may comprise a tri-pod 52 or other similar multi or single leg supports most typically used for supporting a camera. In such embodiments, a threaded fastener 54 extending from the tri-pod 52 may engage a single threaded receiver 56 centrally located in the plate 46.

In use, the first mating member 30 is attached to the firearm 12 and the second mating member 40 is attached to the support member 13, such as the upper edge 16 of the wall 14 or to the tri-pod mount. The wall 14 may most often comprise a hunting stand railing or a structure similar thereto where aiming in a stabilized manner can difficult and where the size of the aiming assisting device should be relatively small. When the user is aiming the firearm 12, the first mating member 30 is placed in the second mating member 40 to stabilize the firearm 12 as the barrel 20 is rotated to track game being hunted and to prevent movement of the firearm 12 up to and during the discharging of the firearm 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A stabilizing system for a firearm to facilitate aiming when shooting the firearm, the system including:

a first mating member configured to be attached to a bottom surface of the firearm;

a second mating member configured to be mounted on an upper edge of a wall, the first and second mating members being magnetically attached to each other to stabilize the firearm when the firearm is being discharged, wherein the second mating member includes a plate having a concavely arcuate depression, the concavely arcuate depression being positioned in a central area of an upper surface of the plate, the first mating member resting within the concavely arcuate depression when the first mating member is magnetically attached to the second mating member, and a plurality of fasteners extending through the plate and into the upper edge of the wall to releasably, retain the plate on the wall, the plate being held in a static position while the fasteners engage the wall; and wherein the concavely arcuate depression defines a less than semi-spherical surface such that the first mating member is configured for releasing from the second mating member due to recoil of the firearm upon discharge of the firearm.

2. The stabilizing system for a firearm according to claim 1, wherein the first mating member and the second mating member are rotatable in three axes with respect to each other when magnetically coupled to each other.

3. The stabilizing system for a firearm according to claim 2, wherein the first mating member has a lower portion being convexly arcuate, the second mating member having an upper surface including a concavely arcuate depression for receiving the first mating member.

4. The stabilizing system for a firearm according to claim 2, wherein the first mating member has a spherical shape, a connector being attached to the first mating member and releasably attaching the first mating member to the firearm such that the first mating member extends downwardly from the bottom surface.

5. The stabilizing system for a firearm according to claim 1, wherein the first mating member has a spherical shape, a connector being attached to the first mating member and releasably attaching the first mating member to the firearm such that the first mating member extends downwardly from the bottom surface.

6. A stabilizing system for a firearm to facilitate aiming when shooting the firearm, the system including:

a first mating member configured to be attached to a bottom surface of the firearm;

a second mating member configured to be mounted on a support member, the first and second mating members being matingly attached to each other to stabilize the firearm when the firearm is being discharged, wherein the second mating member includes a plate having a concavely arcuate depression, the concavely arcuate depression being positioned in a central area of an upper surface of the plate, the first mating member resting within the concavely arcuate depression when the first mating member is mated to the second mating member, and a plurality of fasteners extending through the plate and into the upper edge of the wall to releasably retain the plate on the wall, the plate being held in a static position while the fasteners engage the wall; and wherein the concavely arcuate depression defines a less than semi-spherical surface such that the first mating member is configured for releasing from the second mating member due to recoil of the firearm upon discharge of the firearm.

7. The stabilizing system for a firearm according to claim 6, wherein the first mating member and the second mating member are rotatable in three axes with respect to each other and are magnetically coupled to each other.

8. The stabilizing system for a firearm according to claim 7, wherein the first mating member has a lower portion being convexly arcuate, the second mating member having an upper surface including a concavely arcuate depression for receiving the first mating member.

9. The stabilizing system for a firearm according to claim 7, wherein the first mating member has a spherical shape, a connector being attached to the first mating member and releasably attaching the first mating member to the firearm such that the first mating member extends downwardly from the bottom surface.

10. The stabilizing system for a firearm according to claim 7, wherein the support member is an upper edge of a wall.

11. The stabilizing system for a firearm according to claim 6, wherein the first mating member has a spherical shape, a connector being attached to the first mating member and releasably attaching the first mating member to the firearm such that the first mating member extends downwardly from the bottom surface.

12. The stabilizing system for a firearm according to claim 6, wherein the first and second mating members are magnetically coupled to each other.

* * * * *